United States Patent [19]

Crawford et al.

[11] Patent Number: 4,712,357

[45] Date of Patent: Dec. 15, 1987

[54] COMPUTER CONTROLLED HORIZONTAL WRAPPER

[75] Inventors: Donald C. Crawford, Green Bay; Jeffrey L. Ross, Pulaski; Gary P. Strike, Appleton; Steven W. Mory, Green Bay, all of Wis.

[73] Assignee: FMC Corporation, Chicago, Ill.

[21] Appl. No.: 792,084

[22] Filed: Oct. 28, 1985

[51] Int. Cl.[4] ..... B65B 9/06; B65B 57/04

[52] U.S. Cl. ..... 53/450; 53/55; 53/75; 53/550

[58] Field of Search ..... 53/51, 55, 58, 500, 53/501, 75, 450, 550, 551, 552; 364/469

[56] References Cited

U.S. PATENT DOCUMENTS

| | | | |
|---|---|---|---|
| 3,457,695 | 7/1969 | McCollough et al. | 53/501 X |
| 4,023,327 | 5/1977 | Simmons | 53/51 |
| 4,381,637 | 5/1983 | Ballestrazzi et al. | 53/51 |
| 4,506,488 | 3/1985 | Matt et al. | 53/55 |
| 4,525,977 | 7/1985 | Matt | 53/55 |
| 4,549,386 | 10/1985 | Wilson | 53/51 |
| 4,553,368 | 11/1985 | Ziller | 53/51 |
| 4,574,566 | 3/1986 | Eaves et al. | 53/55 X |

*Primary Examiner*—Horace M. Culver

*Attorney, Agent, or Firm*—Douglas W. Rudy; Richard B. Megley

[57] ABSTRACT

The horizontal wrapping machine of the type wherein a succession of articles are fed into a traveling tube of web material which is sealed longitudinally and severed and sealed between the articles to produce individual hermetically sealed packages. A variable speed motor drives a conveyor which may be provided with article feeding flights and a switch, actuated once each revolution of a timing shaft, provides a pulse corresponding to each flight on the article feeding conveyor. In addition an encoder driven by the variable speed drive motor shaft provides a digital velocity signal used as a reference signal for servo motors that may be coupled, in combination or individually, to drive web feed rolls, longitudinal sealing wheels and one or more sealing and severing heads. A delivery conveyor transporting individual packages may, through a suitable drive train, be driven by the variable speed drive motor. The velocity and position of the servo motors is established and controlled through an industrial computer, at a percentage of the velocity of the variable speed drive motor. Thus, the digital velocity and position signal input to the computer by the encoder driven by the variable speed drive motor establishes a reference velocity and position the servo motors.

2 Claims, 10 Drawing Figures

COMPUTER CONTROLLED HORIZONTAL WRAPPER

This invention relates to a horizontal wrapping machine and more particularly to a wrapping machine provided with electronically controlled servo motors coupled to drive machine elements at a velocity and position dependent upon a reference velocity and position established by a master encoder coupled to a variable speed main drive motor.

Patented prior art relating to the subject matter of the present invention includes U.S. Pat. Nos. 4,525,977 and 4,106,262. By reference to the above patents and references cited therein it is intended that they be incorporated herein.

The present invention incorporates a conventional variable speed main drive motor not only driving the wrapper receiving conveyor, but serving as a master drive in a computer controlled servo drive controlled scheme involving two or more slave drives joined to follow the movement of the main drive by control signals from an motion controlled computer. According to this arrangement, the servo driven horizontal wrapper is controlled digitally on a machine time rather than a real time basis.

Further, in accordance with the present invention, utilizing digital control techniques and providing proportional control of a horizontal wrappers' servo drive slave motors for rapid and accurate position error corrections, makes possible quick size changeover with minimized production of scrap and enabling accurate cutoff and registration control during all wrapper operating phases. Moreover, providing a digital error proportional control scheme for web print registration compensates for gradual change of print repeat or feeding characteristics of the web driving elements.

Also in accordance with the present invention, a computer controlled "high performance" drive arrangement enables the cutting head servo drive to run at relatively constant velocity since the variable cyclic velocity is achieved by a mechanical arrangement converting a constant input velocity to a variable cyclic velocity. Use of this mechanical arrangement lends itself to be adaptable for driving two or more cutting and sealing heads with one servo motor.

Further, according to the present invention providing analog wrapping rate control of a digital computer controlled servo wrapper enables manual setting of wrapping rate with a potentiometer or automatic selection between multiple preset potentiometers or automatic response to an analog control signal from the process supplying the wrapper. This makes possible practical and conventional means for automatically controlling article backlog by cycling the wrapper responsive to the process control signal. Additionally, a computer controlled servo drive wrapping system employing a one to one switch for a pulse reference of an article rather than sensing articles or flights avoids or attenuates irregularities as the wrapper will ignore or not respond to minor irregularities of article position.

BRIEF DESCRIPTION OF PREFERRED EMBODIMENT

Figure 1:
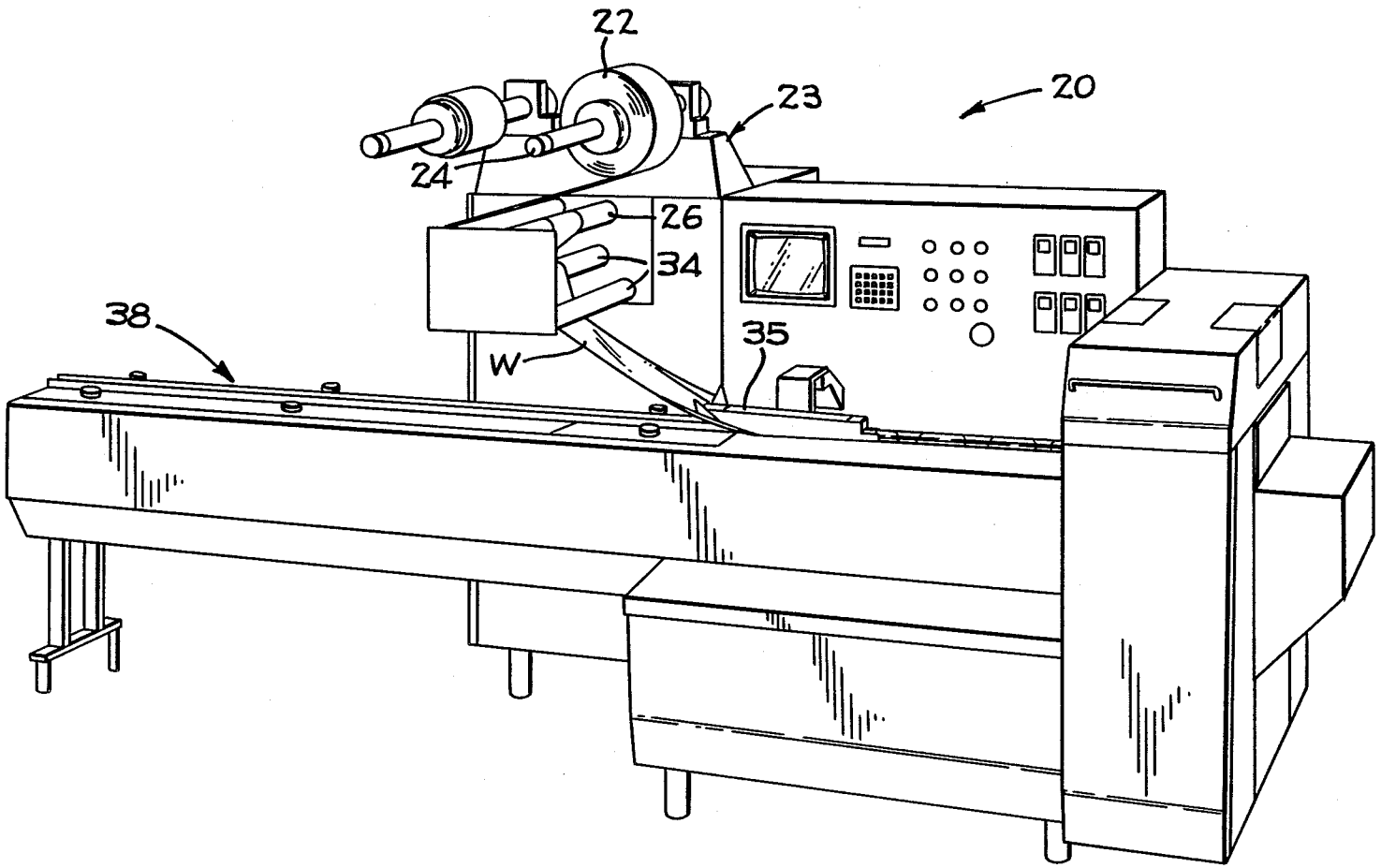
FIG. 1 is a perspective of a horizontal wrapping machine incorporating the novel subject matter of the present invention.
Figure 2:
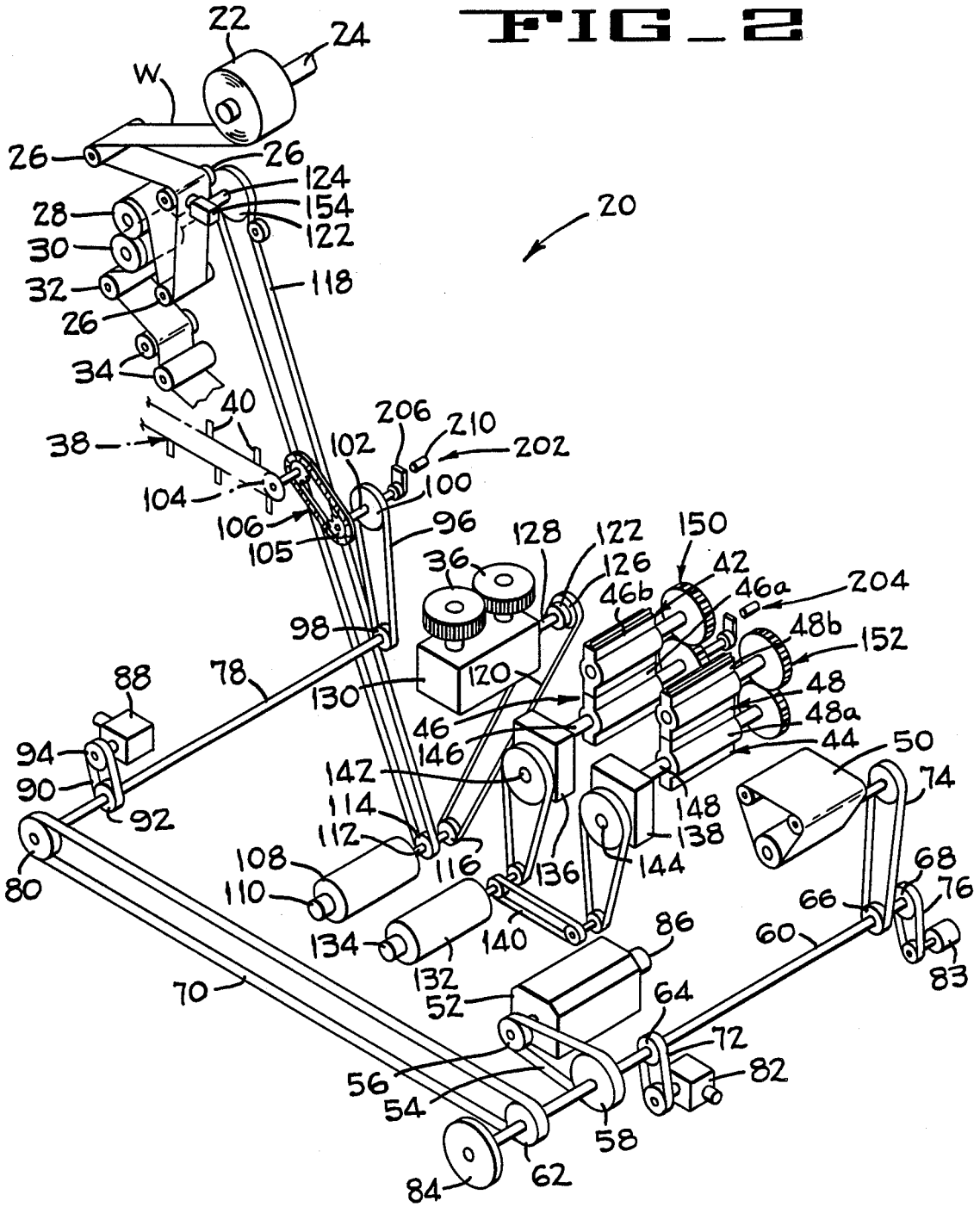
FIG. 2 is a perspective diagramatic of a drive arrangement for a wrapping machine combining elements that achieve high performance capabilities and includes web drive rolls driven by a servo motor, FIG. 3, also a diagramatic perspective, illustrates a wrapper configuration in which the web unwound from a roll of web material is achieved by servo driven tandem fin wheels.

A wrapping machine achieving high wrapping rates, which for purposes of this disclosure means 250 or more packages per minute, illustrated in FIG. 1 and 2 is generally identified by the numeral 20. Web material supplied by a web roll 22 mounted on a suitable unwind stand 23 includes a support shaft 24. The web strip W is directed over idler rolls 26 and wrapped over and passed between nip rolls 28 and 30 one of which, preferably roll 28, is a rubber covered roll and the other roll 30 being a metal roll. The web strip passes over a roll 32 and over guide rolls 34 and thereafter is engaged by a forming device 35 of conventional construction functioning to form that flat web strip into a tube such that the opposed longitudinal edges form a longitudinal fin which is received between and sealed by heated fin wheels 36. An article supply conveyor 38, which may be provided with lugs or flights 40, feed a supply of longitudinally spaced articles into the web tube produced by the former 35 and are then transported in spaced relationship by the web tube to one or more crimping devices operating to sever and seal the web tube along a transverse line in the region of the web tube unoccupied by articles. The wrapper configuration shown in FIG. 2 discloses tandem crimping and sealing heads 42 and 44 comprising crimping and sealing devices 46 and 48 that crimp, seal and sever the web tube during each 180 degrees of shaft revolution. Articles which have been sealed within a portion of the web tube are discharged to a delivery conveyor 50 from which the completed packages are either manually or automatically cartoned for shipment.

According to the present invention a conventional variable speed motor 52, preferably a DC motor, is connected to drive the infeed conveyor 38, the delivery conveyor 50 and, through suitable power takeoffs, upstream and downstream accessories that may be incorporated in the wrapping system. The conventional motor 52, sometimes hereinafter referred to as the master or main drive motor is coupled to a master encoder 83 which provides a machine time signal to a computer which controls slave servo drives with encoders to follow the movement of the master encoder 83. The computer controlled high performance drive arrangement as shown in FIG. 2 provides a drive arrangement whereby a servo motor slaved to the main drive runs at relatively constant velocity while the crimping heads 42 and 44 driven thereby operate at variable cyclic velocity through a mechanical arrangement converting the constant velocity input from the servo motor to cyclic variable velocity.

With reference to FIG. 2 it will be seen that the main or master motor 52 drives, by a belt 54 connecting the pulley 56 mounted on its output shaft and a pulley 58, an elongate transverse shaft 60 having fixed along its length pulleys 61, 64, 66 and 68 driving, by means of timing belts 70, 72, 74 and 76, an upstream elongate transverse shaft 78 mounting a pulley 80 driven by the belt 70, a power takeoff unit 82, the delivery conveyor 50 and an encoder 83, respectively. At its outboard end the shaft 60 has keyed thereon and a hand wheel 84. The main motor 52 may also be provided with a tachometer 86 serving to improve or maintain constant closed loop velocity control.

The elongate transfer shaft 78 driven by the main motor 52 through the belt 70 drives a PTO 88 through a belt 90 interconnecting pulley 92 and pulley 94 fixed to the input shaft of the PTO 88. PTOs 82 and 88 may be used to drive a plurality of accessories such as automatic feeders, carad sheeters, code daters, printers, imprinters, punching stations, collators, cartoners, and a variety of other accessories that are necessary to fulfill particular wrapping requirements. By means of a belt 96 and associated pulleys 98 and 100 fixed to, respectively, shaft 78 and a shaft 102 the article supply conveyor 38 is driven to supply a succession of articles carried thereby into the web tube. A drive pulley or sprocket 104 of the conveyor 38 is connected to the shaft 102 by a sprocket-chain drive 106. Changes in speed in the article supply conveyor 38 due to product length determining the distance between flights or lugs 40 are preferably achieved by changing sprocket 105 of the drive 106 to thereby produce a drive ratio proportional to the wrapper speed. The disclosed arrangement of changing the feed conveyor speed is relatively simple and inexpensive and it is satisfactory for a majority of wrapper applications.

The web drive nip rolls 28 and 30 and the fin wheels 36 are driven by a servo motor 108 provided with a suitable shaft encoder 110 supplying velocity signals to an industrial motion computer which will hereinafter be identified. On the output shaft 112 of servo 108, mounting pulleys 114 and 116 drive, by means of belts 118 and 120, respectively, the nip roll 30 through a pulley 122 mounted on a shaft 124 and the fin wheels 36 by a pulley 126 secured to an adjustable torque device 212 mounted on a shaft 128 extending from a gear box 130 operating to concurrently rotate the fin wheels 36.

Another servo motor 132, having coupled thereto an encoder 134, drives crimping and sealing heads of 42 and 44. Variable cyclic velocity to the crimping heads is provided by mechanical slot drive units 136 and 138 which are of conventional construction. The servo motor 132, through a belt and pulley transmission generally identified as 140, drives units 136 and 138. Power input shafts 142 and 144 associated, respectively, with the slot drive units 136 and 138, drive output shafts 146 and 148 at a cyclic variable velocity such that when the crimping and sealing faces of the crimping devices 46 and 48 come in contact with the web tube the velocity matches that of the web tube. The lower crimpers **46*a* and 48*a* are fixed, respectively, to output shafts 146 and 148 and by means of gear sets 150 and 152 the upper crimping heads 46*b* and 48*b* are concurrently driven in time relation with crimpers 46*a* and 46*b***.

In the event film with a printed registration mark is used a film registration mark detector 154 generates a signal which is input to the motion control computer being programmed to control servo motor 108 to maintain a preset phase relationship between the printed web register marks and the flights 40 of the article supply conveyor 38. Such a relationship achieves very accurate control of the web cutoff and print registration by controlling the drive to the web feed rolls since 28 and 30.

Figure 3:
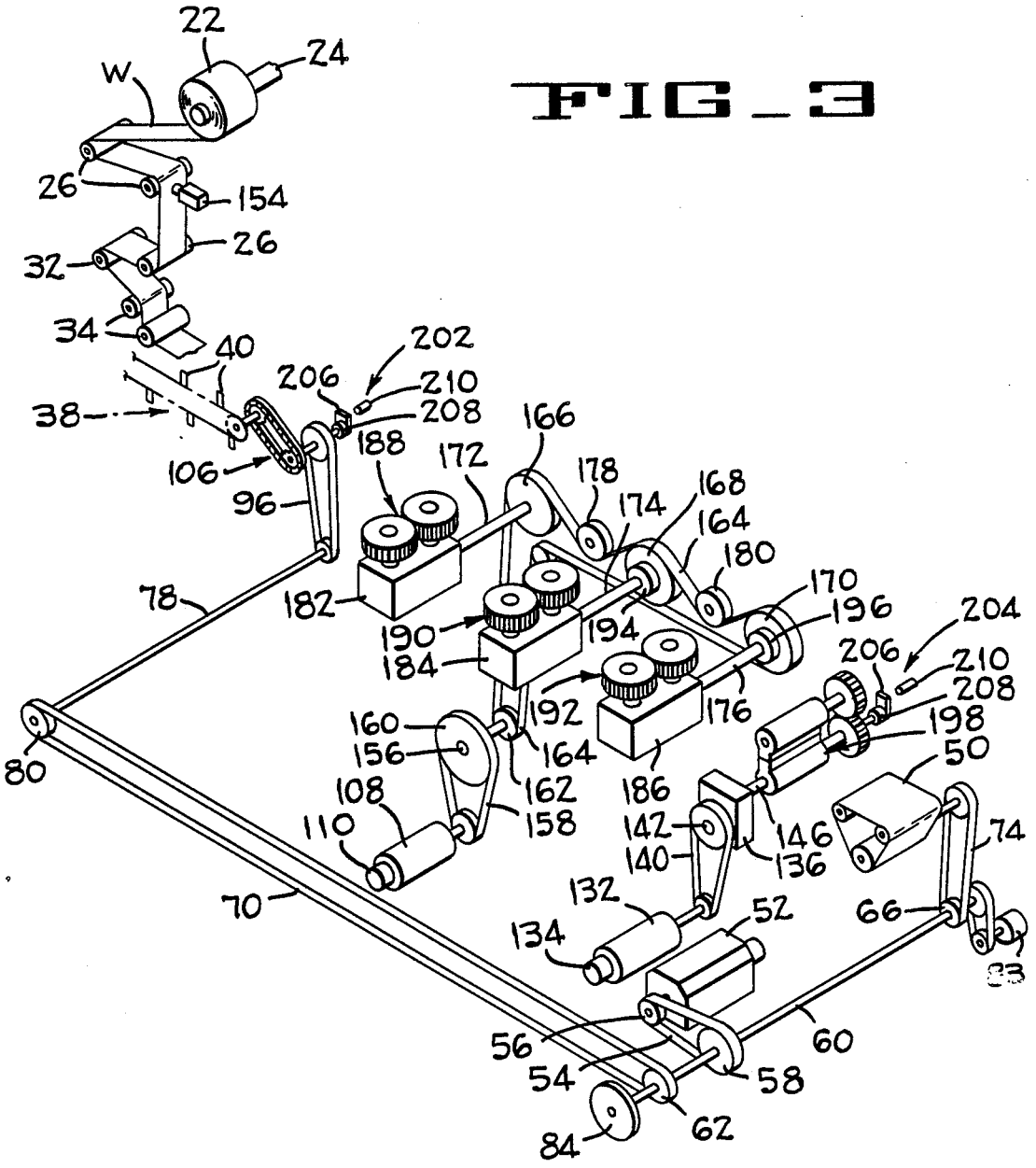

The drive arrangement of the wrapper shown in FIG. 3 is in major respects similar to the above described arrangement and the same numerals will be used to identify the same or similar elements. The principle modifications of involve the absence of web drive rolls 28 and 30, one of the crimping heads and the provision of three sets of fin wheels driven by servo motor 108. As shown in FIG. 3 the servo motor 108 drives a shaft 156 by belt 158 engaging a pulley 160 keyed to shaft 156. Shaft 156 also mounts a pulley 162 driving a belt 164 passing over drive pulleys 166, 168 and 170 keyed, respectively, to shafts 172, 174 and 176. Idler pulleys 178 and 180 serve to increase the arc of contact between the belt 164 and the drive pulleys 166, 168 and 170. Gear boxes 182, 184 and 186 drive opposed pairs of fin wheel 188, 190 and 192 with the driving power therefore being supplied by the shafts 172, 174 and 176, respectively.

According to the construction of FIG. 3 the rate at which web is unwound from the supply roll is directly related to the velocity of servo motor 108 and accordingly the surface velocity of the fin wheels directly corresponds to a desired film velocity. To establish a predetermined web tension between the fin wheel 188 and the web as it is unwound from the supply roll 22 a conventional drag brake may be utilized. Fin wheels 190 and 192 serve to provide a predetermined tension to the web by incorporating adjustable torque devices 194 and 196 on shafts 174 and 176. Commercially available adjustable torque devices provide a percentage of overspeed when unloaded (herein meaning when running without web) and when loaded slip at a preset torque level to produce a desired degree of web tension to the web portion between the fin wheels.

FIG. 3 illustrates a crimping head 198 driven at cyclic variable velocity by the servo drive unit 132 but it should be noted that the crimping head engages, crimps and severs, the web once during each revolution of the shaft 146. In the art this is referred to as a "1-up head" while the crimping heads 42 and 44 shown in FIG. 2 are usually referred to as "2-up heads" since during each 360 degree revolution two crimps and seals are made.

Figure 4:
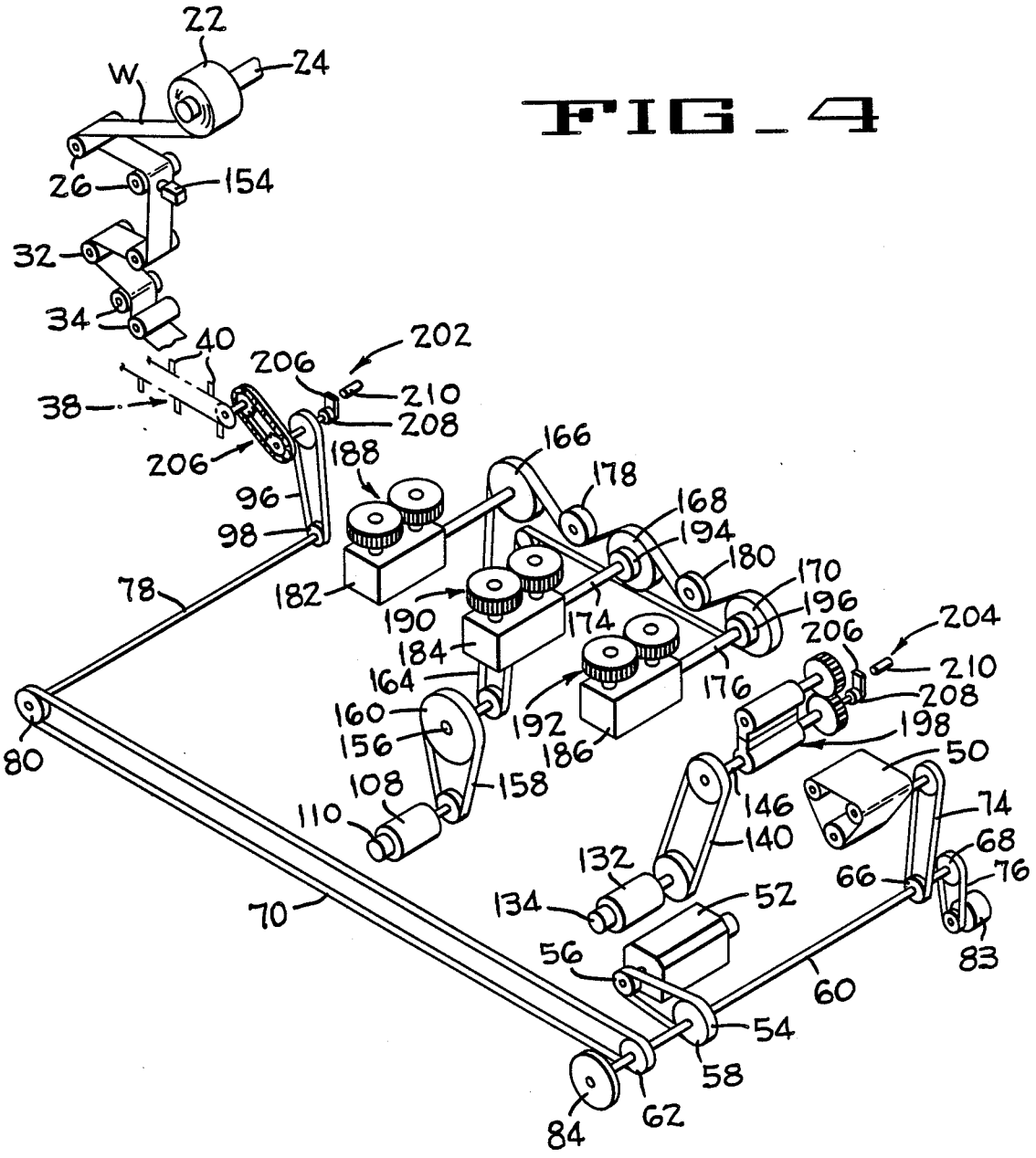
FIG. 4 is substantially similar to FIG. 3 but the drive to sealing/crimper and cutoff jaws is by means of a variable velocity, servo motor, FIG. 5 discloses a wrapper driver arrangement similar to FIG. 2 with the exception that a single 2-up crimping head is driven by a servo motor.

The wrapping machine drive arrangement shown in FIG. 4 is in all respects similar to the arrangement shown in FIG. 3 and accordingly the corresponding structures will be identified by the same numerals. As in the prior arrangements input power to the crimping head 198 is supplied to servo motor 132 being directly connected to drive the shaft 146 by the belt and pulley transmission 140. To achieve cyclic variable velocity of the crimping head 198 the servo motor 132 accesses a program in the industrial computer to provide the appropriate cyclical speed variation for a specified wrapping application. The arrangement shown in FIG. 4 renders unnecessary the slot drive unit 136 which, as mentioned above, transforms a constant input rpm to a cyclically variable velocity. By achieving variable cyclic velocity of the crimping heads 198 by constantly varying the velocity of the servo motor 132 may require, since electrical current peaks are high, forced air cooling to the servo motor. Direct servo drive to the crimping head 198 may be best suited for single head wrapping applications where there are many different article sizes to be wrapped and where size changeover is to be quickly performed and at the same time allowing use of a less skilled operator.

Figure 5:
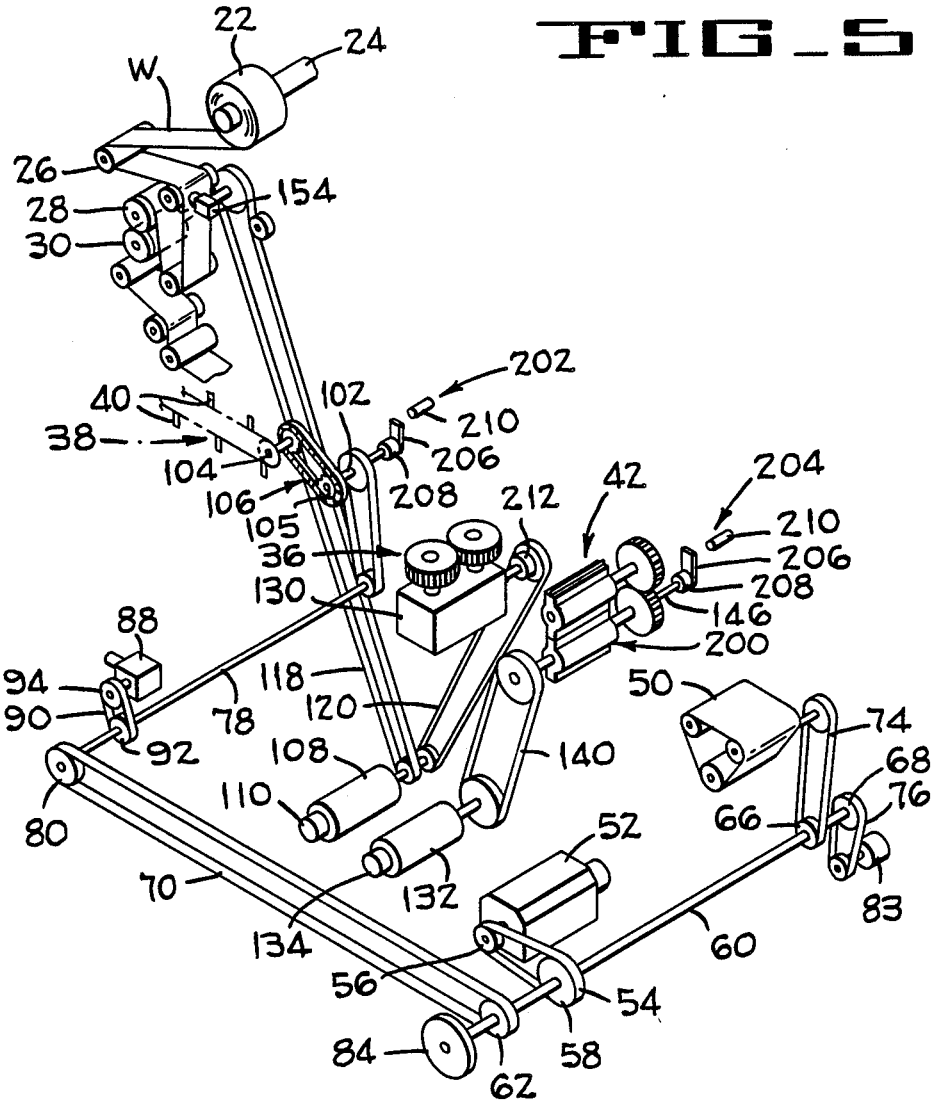

The arrangement of the wrapper components shown in FIG. 5 in large part include a major portion of the components shown in FIG. 2 but deviate therefrom by eliminating PTO 82 and directly drives, by servo motor 132, a 2-up crimping head 200 whose velocity is cyclically varied during each 180° of revolution by computer control.

The wrapper configurations shown in FIGS. 2 to 5 all include a detector 202 including a radially projecting flag 206 mounted on a shaft 102 driving the infeed conveyor 38 and a detector 204, of similar construction, including a radially projecting flag 206 which is mounted on shaft 146 of the crimper head 42. The radially projecting flag 206 carried by collar 208 adjustably mounted to the shaft 102 and a light source 210 being operative to generate a pulse when the flag 206 crosses its light path during each revolution of the shaft 102. In setting up the machine the photo detector 202 is correlated with the position of the lugs or flight 40 of the infeed conveyor 38. Preferably, a pulse is generated by the detector 202 as each flight 40 loses contact with an article which is inserted into the web tube. This condition can always be established for a particular product length since the collar 208 can be adjusted so that the pulse created always occurs when the flight 40 comes out of contact with the article being inserted into the web tube. The pulse generator by the detector 202 is sensed by the computer and provides a reference signal for controlling relative velocity of the entire drive train. The encoder 83 being driven, through belt 76, by the shaft 60 provides digital velocity and position signal corresponding to the velocity and position of the main drive motor 50 which is used by the computer to generate control signals for servo motors 108 and 132. The flat 206 associated with detector 204 is adjusted on shaft 146 so that a pulse is generated when the sealing and crimping faces of the crimper head carried by shaft 146 are completely closed.

Servo motor 108 drives all web feeding and tensioning elements in the system by means of belts 118 and 120 driving, respectively, the feed rolls 28 and 30, and fin wheel 36. The feed rolls have primarily control over web velocity and print registration through the agency of encoder 110 providing a digital feedback signal for velocity and position of the web. The computer (hereinafter identified) is programmed so that servo motor 108 follows the master encoder 83 at a preset ratio to thereby feed a selected amount of web material for each flight 40 advanced by the main drive motor 52. Accurate control of web velocity is provided by the print registration scanner 154 inputting a pulse to the computer on the detection of of a registration mark and in turn, through the computer, servo motor 108 maintains a position relationship between the web registration mark and the flight 40 of the infeed conveyor 38. By these measure very accurate control of the web cutoff and print registration is achieved through control of the web feed rolls 28 and 30.

To achieve and maintain a desired web tension as the web leaves the web feed roll 28 and 30 the drive to the fin wheels 36 (FIG. 2) include a commercially available adjustable torque device 212 which is set or adjusted so that the surface velocity of the fin wheels 36 is approximately five percent over speed relative to the speed or surface velocity of the fin wheels 26 and 28 when running without web between the wheels 36. The adjustable torque device serves to tension the web by slipping at a preset torque level and thereby produces a desired web tension between the feed rolls 28 and 30 and the set of fin wheels 36.

Servo motor 132, serving to drive the crimping and sealing heads of 42 and 44 provides, by means of the encoder 134, a feedback digital velocity signal corresponding to the velocity of one of the input shafts 142 or 144 of the slot drive units 136 and 138. The computer is programmed to compare the velocity feedback signal from encoder 134 with the velocity of the reference signal of encoder 83 to effect control of servo motor 132 such that a 1:1 ratio between the input shafts 142 and 144 of the slot drives 136 and 138 will make one revolution for each advance of a flight 40 of the infeed conveyor 38. Detector 204 monitors motion of the lower cutting head shaft and produces an output pulse for each crimping, sealing and cutting cycle. The computer is programmed to compare pulses it receives from detectors 202 and 204 relative to the infeed conveyor 38 and to control servo motor 132 in such a way as to maintain a preset desired phase relationship between the pulses generated by detectors 202 and 204. In this way the computer and servo motor 132 control the phasing of the cutting head to the article within the tube of packaging material.

The slot drive units 136 and 138 may comprise a disc having a diametrical slot receiving a pin fixed to the face of a gear transmitting power to a gear train having the last gear of the train connected to drive the lower shaft, for example, shafts 146 and 148, of a crimping head. Means are provided for adjusting the eccentricity of the disc with the gear carrying the pin slidably movable in the slot formed in the disc. A vernier adjustment for setting the eccentricity and accordingly the period of cyclic variable velocity during one revolution of the crimping heads 42 or 44 is provided. Values of eccentricity required for packages of different lengths are stored in the computer and accordingly during setup of the machine setting the eccentricity of the slot drive units 136 and 138 is displayed by the computer to achieve an appropriate speed match between the crimping and sealing jaws related to the spacing of the articles in the web tube in order to achieve correct crimping, sealing and cutting of the web tube between articles. Where serial crimping heads such as shown in FIG. 2 are used, the servo motor 132 drives crimping heads 42 and 44 the computer is programmed to prompt a number for setting the timing dial on the input shaft of the crimping head 44. Selecting this number sets the timing of the crimping head 44 relative to the crimping head 42. In addition, the computer also prompts a number for setting the eccentricity in the slot drive unit 138. According to this arrangement servo motor 132 runs at constant velocity and develops a fly wheel effect in the slot drive units 136 and 138 being effective to smooth out the acceleration loadings of the cyclically varying output to shafts 146 and 148. Thus servo motor 132 does not experience acceleration and deceleration peaks which in turn avoids heat generation occasioned by high currents.

Directly driving a crimping head, shown in the machine configuration of FIGS. 4 and 5, eliminates the need of a slot drive unit such as unit 136 and the requirement of cyclic variable velocity is fulfilled by the computer. While the mechanical drive arrangement is simple, electronically it is more complex because the servo drive arrangement for the servo motor 132 must, during every revolution vary the velocity. More particularly, the computer is provided with a program accessed by the encoder 134 to effect the cyclical varying velocity. The design of the servo motor 132 and its controller in this arrangement is much more critical because of load accelerations and decelerations that are not smoothed out by the flywheel effect of a slot drive and accordingly current peaks are high requiring proper sizing of servo motor 132 and its electrical conductors. Moreover, the duty imposed on servo motor 132 may require forced air cooling. The direct drive arrangement is envisioned to be best suited for single head wrapping applications where there are many different article sizes to be wrapped and where size changeover is to be quickly performed and where operator skill requirements is to be minimized. For example, to effect cyclical speed variations for the crimping head, the operator merely has to input information into the computer concerning the article to be wrapped, or in the event the computer contains the job code in memory, that information is brought up to the active record meaning, the job being run.

The arrangement shown for driving the delivery conveyor 50 is a low cost and practical solution for achieving delivery conveyor speed being proportional to the wrapper speed. The drive ratio, which may be adjusted by selection of appropriate pulley diameters is optimized for a specified maximum cut-off of a given wrapping application. While this is a satisfactory arrangement for a majority of wrapping applications, some wrapping applications require delivery conveyor velocity to be in fairly close proportion to web velocity. This may be achieved by using servo motor 108 to also drive the delivery conveyor, a separate motor and controller and employ the control signal for servo motor 108 as the control signal for open loop control of the delivery conveyor drive or provide a separate servo drive motor and controller axis to drive the delivery conveyor.

Figure 6:
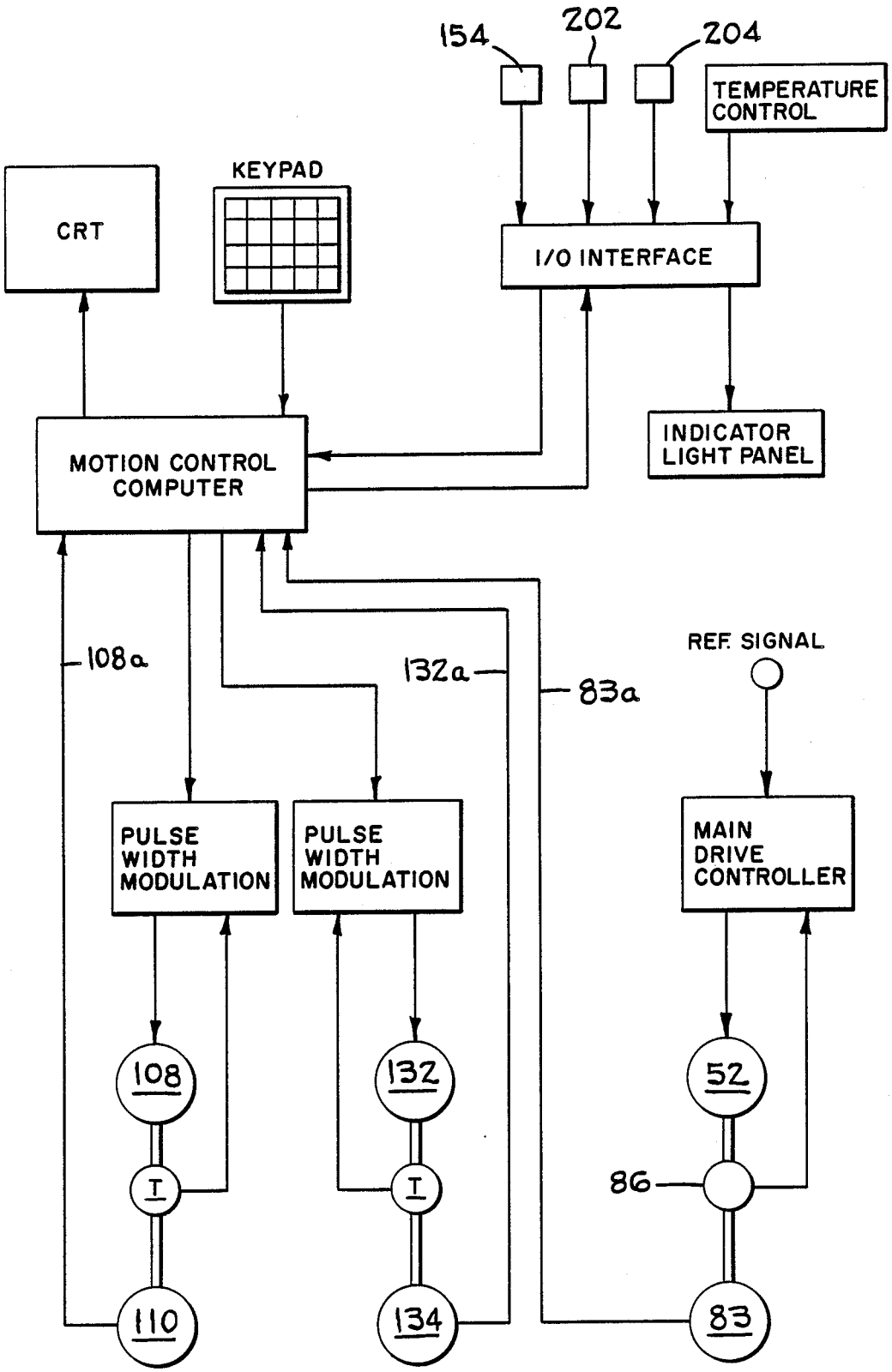
FIGS. 6 is an electrical schematic illustrating the major electrical and electronic components and their interconnections.

FIG. 6 is a schematic of the major drive and control elements of the system showing their integration with the motion controlled computer. The master or main drive motor 52 is electrically connected to a controller which receives a reference signal which may be a set voltage such as one established by a potentiometer or a varying voltage which may be automatically varied according to transitory or transitional conditions or the voltage may be input in accordance with the rate at which a process is operating. This signal is input to the controller and the speed of the main motor 52 is proportional to the input reference signal. Tachometer 86 connected to the controller provides an indication of motor speed to the controller and thus constitutes a closed loop speed control of the motor 52. The encodes 83, driven by the motor 52, inputs a velocity signal through line 83a to the motion control computer and as mentioned above, this velocity signal establishes a reference velocity for the servo motors 108 and 132. Servo motors 108 and 132 are associated with pulse width modulated drive controllers (PWM) regulating power to servo motors 108 and 132. Tach T provide a velocity signal to the pulse width modulators, thereby, establishing closed loop control. Velocity signals of the servo motors 108 and 132 are supplied to the computer by lines 108*a* and 132*a*. A CRT displays a variety of information which may include conditions of machine operation and information prompted by the operator's use of the keypad to call up or establish a record. Also connected to the motion control computer by an I/O interface, the pulses generated by the registration mark detector 154, the dog drop off detector 202, the crimper position detector 204, temperature control and light indicator panel. A keypad is connected to the computer to inputs parameters necessary to run a particular wrapping job.

Figure 7A:
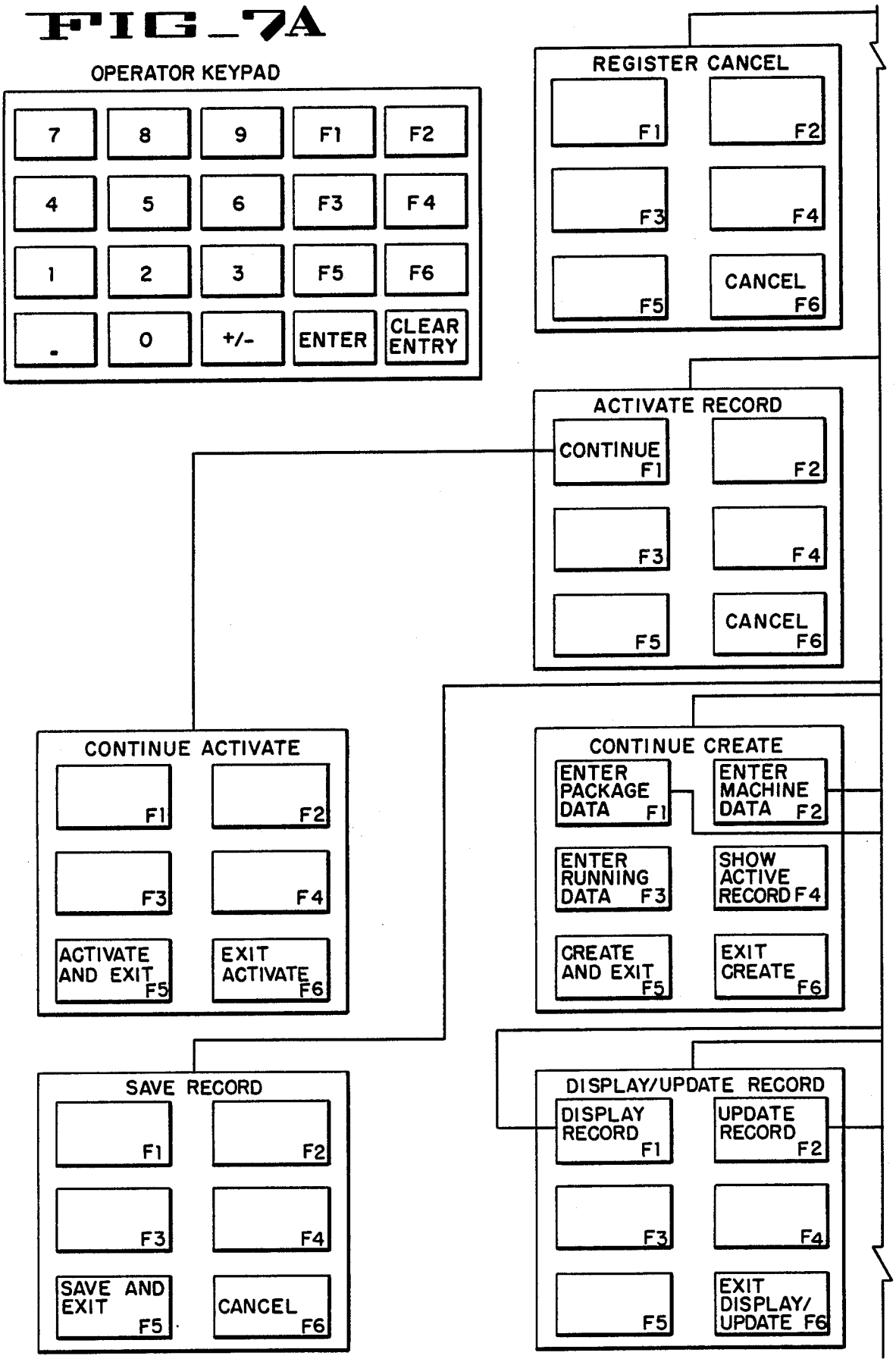
FIGS. 7A, 7B and 7C are function maps showing the various menus available for storage in the computer.
Figure 7B:
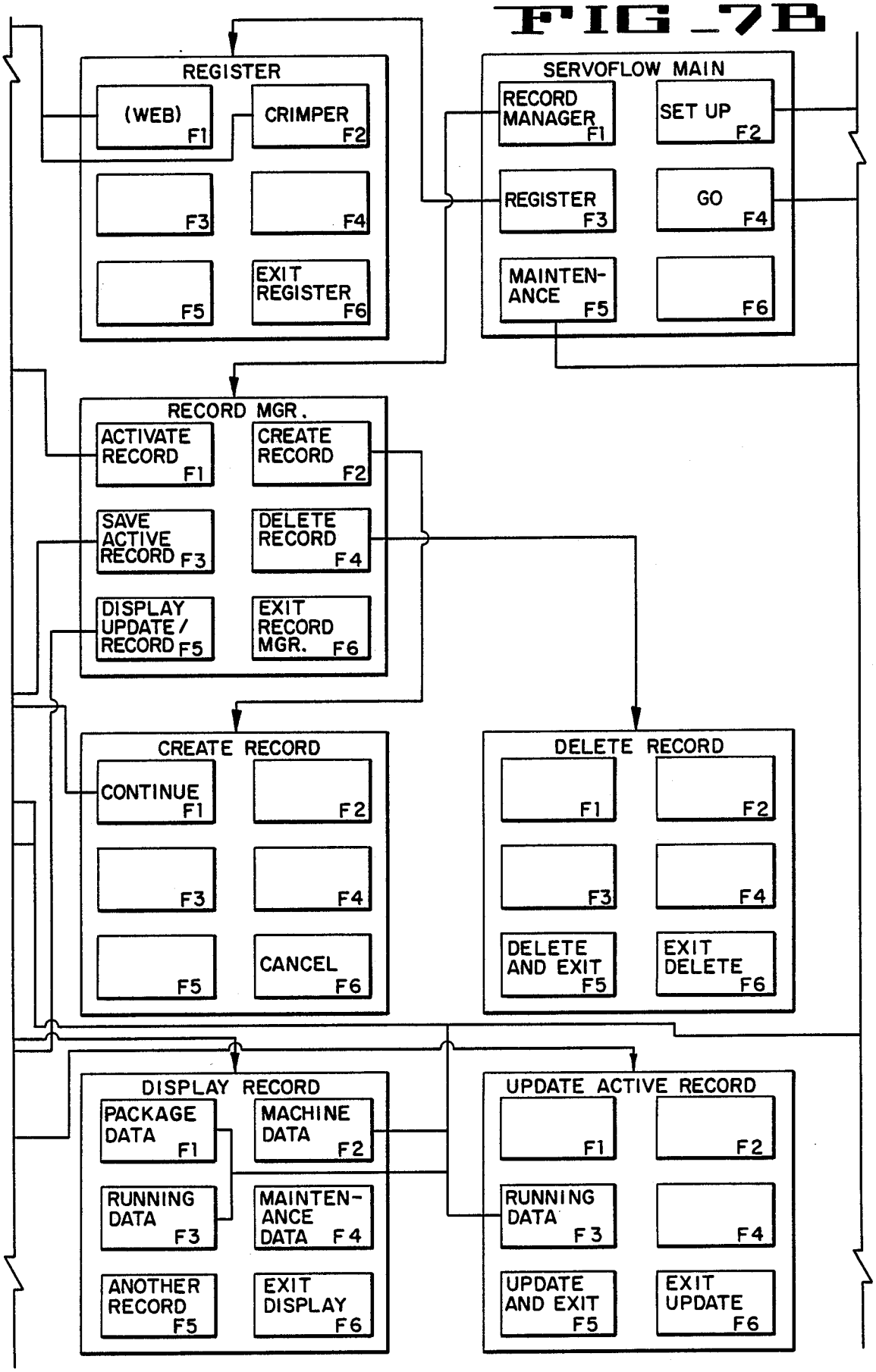
Figure 7C:
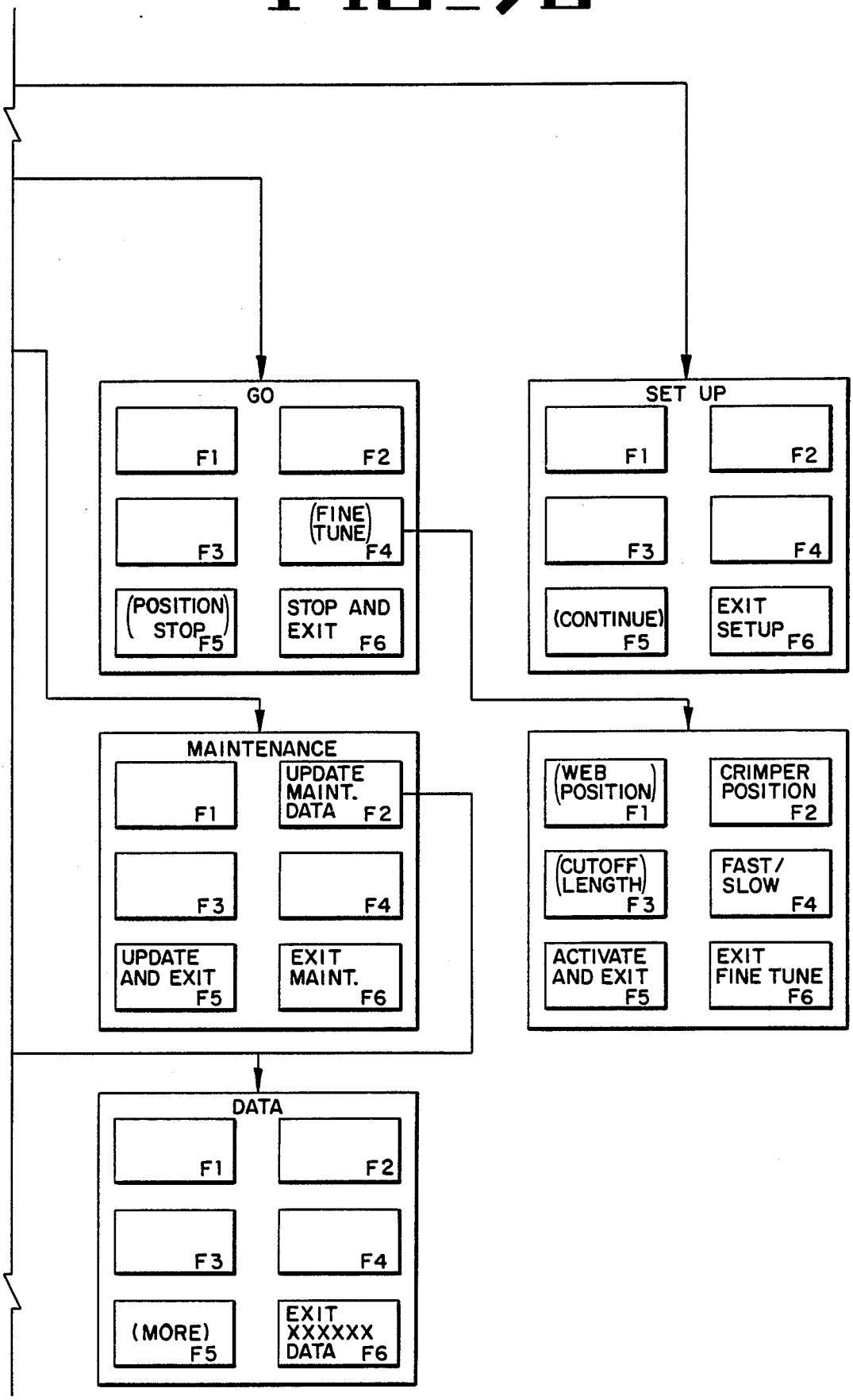

FIGS. 7A, 7B, and 7C considered together schematically show computer prompted information displayed on a CRT to create a record for a particular job desired to be run. By "job" it is primarily meant for information concerning the article to be packaged and the web material to be used. Standard input variables consist of four sets of data comprising packaged data, machine data, running data and maintenance data. Certain data is factory input. Packaged data includes film type (registered or non-registered), article lengths, sealed package lengths, and distance from film cut line to leading edge of registration mark. Machine data comprises distance between web sensor and dog drop off, idler arm angle hole number, idler arm extension scale reading, and part number of the former 35. Running data consists of one item namely film cut-off length. Maintenance data comprises running both heads or second head only (this applies to tandem crimper machine only) distance from dog drop off to center line of first active head, receiving conveyor flight length, pitch diameter of the first head, number of crimpers per shaft on the first head, face width of the first head, bearing box orientation of the first head, pitch diamter of the second head (tandem crimper machine only) number of crimpers per shaft of the second head (tandem crimper machine only), face width of second head (tandem crimper machine only), and bearing box orientation of the second head (tandem crimper machine only). Factory inputs comprise single or tandem crimper machine, base distance between crimper center lines and crimper reference velocity which is defined as revolutions of cutting head drive motor 132 per revolution of main drive motor 52. It is to be noted that factory inputs are not accessible to the operator.

For purposes of facilitating understanding of this disclosure, certain words are defined as follows:

RECORD

Refers to all information related to a sepcific job. This information consists mainly of numbers and dimensions. These numbers and dimensions refer to film type, package geometry and machine set-up parameters necessary to run the specific job.

ACTIVE RECORD

Means the record which the computer is using to control the present job. Up to 24 cataloged individual records may exist in the computer's memory and may be selected as the active record.

PACKAGE DATA

Means any information on the film and package dimensions to run a specific job.

MACHINE DATA

Means information input by the operator on machine parts and dimensions needed to run a specific job.

RUNNING DATA

Means set-up and operating parameters recommended or controlled by the computer for a specific job.

MAINTENANCE DATA

Means maintenance input information on machine parts and dimensions needed to run a specific job.

FUNCTION

Means a descriptive reference to the action taken by the machine when a key is pressed. A keypad provides the operator with six function keys.

MENU

Means a particular set of 1 to 6 functions assigned to the six keypad function keys at any given moment.

FIG. 7A illustrates the operator's keypad which includes several single digit numerical keys and six function keys identified as F1 to F6. In addition, an enter and clear entry keys are included. While an example describing the inputs to create an active record for a specific job will be described hereinafter, the general procedure involves four basic steps fulfilled by sequentially pressing keys F1 to F4 of the keypad. On supplying power to the machine, the servo flow main menu (FIG. 7B) is displayed on a CRT. Actuating or depressing F1 on the keypad accesses the record manager menu (FIG. 7B) is displayed on a CRT. If the job has been previously run, it will include all of the necessary parameters and the specific job will be given a number. On selection of the job number key F6 on the keypad is depressed and the stored job is put in the active record.

Depressing F2 on the servo flow main menu, displays the set-up parameters for the jub being run. These consist of simple mechanical adjustments to be made on various portion of the machine. Set-up adjustments are normally performed by the operator and need only be done once at the beginning of a job. Set-up is completed by selecting the existing set-up (FIG. 7C) function on the set-up menu.

When the film being used is "registered film" F3 on the keypad is depressed to access the register menu (FIG. 7B). In running a job using registered film, both the web and the crimper are brought into register with the main drive at the beginning of the job. From a machine standpoint this means, that film registration detector 154 and sensors 202 and 204 are adjusted to provide the computer with a pulse which constitutes reference points. Once in register the computer will hold registration of both sections, that is the film and the crimper, well under 1% of the package length under normal operating conditions. The register function is completed by selecting or depressing F6, exit register on the register menu.

The servo flow main menu is again displayed and it will be seen to include key position F4 legend "go". On depressing F4 on the keypad the go menu (FIG. 7C) is accessed in order to enter the normal running mode of operation. At the completion of the job being run, the servo flow main menu (FIG. 7B) may be accessed by selecting the stop and go exit function F6 on the go menu.

According to the above briefly described sequence of operations, it should be evident that a very convenient four step procedure is followed to establish all the data required for a job and that the set-up data may be given a number when stored in the computer memory and it is, therefore, available for future use. In summary, the first step taken is to access the record manager which will allow activation of a record stored in memory. Step 2 activates the set-up menu which will prompt the operator to select mechanical adjustments. The third step activates the register menu (FIG. 7B) prompting the operator to adjust the web and the crimper or crimpers into registration. And the last step is accessing the go menu (FIG. 7C) allows entry of normal running mode.

Creating a record is initiated on depressing F2 of the record manager menu which accesses the create record menu (FIG. 7B). Depressing F1 on the create record menu accesses "continue create" menu at which time the computer will request information on the film and package dimensions. Entering machine dta (F2 continue create menu) prompts the computer to request information on mechanical machine sections contained in menu "display record" (FIG. 7B). Entering machine running data is achieved by depressing F3 on the create record menu which will request film cut-off length. After all required data has been input, depressing F5 on the create record menu stores the selected prompted information in the computer. The computer then determines the remaining set-up and operating parameters (registration, timing, etc.) required to run a specific job. The record created is dependent on the active maintenance input. When the create and exit functions F5 of the continue create menu is actuated, the new record becomes the active record.

The record manager menu save record function may be accessed by depressing key F3 on the keypad. On depressing F3 of the record manager "save record" menu is displayed and it includes a save and exit function which is accessed by depressing F5 on the keypad. Following this procedure saves the active record under a chosen record number.

Updating any particular record is accomplished by depressing key F5 before the corresponding record manager position displays or brings up "display/update record menu" at which time depressing F1 on the keypad will display the record by accessing display record menu (FIG. 7B) at which time the operator is allowed to access, by depressing key F1, the "display record" menu or "the update active record" menu by depressing F2 on the keypad. The parameters determined by the computer may be adjusted slightly by the operator during the first several packages run. At this point, it is generally desirable to update these parameters in the active record and then save the active record. The adjusted values then appear as set-up and operating parameters when the record is selected for future jobs. To leave any data unchanged, it is merely necessary to press "enter" on the keypad at those data entry points. The update and exit function (update active record menu key F5) updates the active record with the new parameters.

CREATING A NEW RECORD

Key F2 on the record manager menu. A record must be created the first time a particular job is run. Once created the record may be saved in the computer memory for easy access on future runs. All requested data must be entered on the create record menu. The create record menu consists of four steps: (1) Enter package data. Depress F1 on the create record menu. The computer will request information on the film and package dimensions. (2) Enter machine data. Depress F2 on the create record menu. The computer will request information on mechanical machine sections. (3) Enter running data. Depress F3 on the create record menu. Film cut-off length is requested here. (4) Create an exit. Depress F5 on the create record menu. This function is selected after all required data has been entered. At this point, the computer will determine the remaining set-up and operating parameters (registration, timing, etc.) required to run a specific job. The record created is dependent on the active maintenance input. When the create and exit function is selected, the new record becomes an active record.

SAVING THE ACTIVE RECORD

Depress F3 on the record manager menu. It is recommended to save the active record after creating a new record or after fine tuning or updating the active record. The save and exit functions saves the active record under the chosen record number. As shown in FIGS. 7B and 7C, selecting the go function from the servo main menu by depressing keypad key F4 accesses the go menu which makes available the fine-tune function accessing the fine-tune menu by depressing key F4 on the keypad. Three of the operating parameters may be fine-tuned while the machine is running. There are "web position" (registered film only), "crimper position", and "cut-off length" (non-registered film only). While on the fine-tune menu, the operator has complete freedom to adjust the parameters to achieve the optimum package characteristics. The fine-tuned parameters will become part of the active record only by selection of the activate and exit function (keypad key F5) and save the active record under the original record number.

To further explain the operation of the disclosed electronic horizontal wrapping machine, a more specific example will be described. On turning on the power from the operator's panel, the servo main menu is displayed on the CRT. Actuating key F5 accesses the maintenance menu (FIG. 7C) which is displayed on a CRT. One of the functions in the maintenance menu provides for updating of maintenance data which is displayed on the screen by depressing key F2 of the keyboard. The data menu is displayed on a CRT as well as three maintenance data descriptions comprising running both crimper heads or second head only, distance from lug or flight 40 drop off to center line of first active head, and receiving conveyor flight length meaning the distance between lugs or flights 40. Machine configuration is entered by depressing numeral 1 if running both heads and 2 if running the second head only. On entry the number will appear directly to the right of the first data description. This information is loaded in the computer by pressing the enter key. The distance from the lug or flight drop off to the center line of the first active head is entered in inches from the numeric pad and the number entered will also appear to the right of the data description. Depressing "enter" loads that parameter in the computer and then the operator will, through the numeric pad, enter the conveyor flight length. The routine continues until all maintenance variable descriptions or parameters displayed on a CRT have been entered. After the last data has been entered, the maintenance menu is again displayed at which time the operator depresses F6 on the keypad bringing up the servo flow main menu on the CRT.

Depressing F1 on the keypad displays the record manager menu which includes function F2, create record, accessed by depressing F2 on the keypad to thereby bring up the create record menu. The record is created by depressing F1 on the keypad displaying the continue create menu which includes the function key F1 wherein, through the CRT, the operator will be prompted to enter package data since the data menu is displayed. As mentioned above, the package data descriptions include film type (registered or non-registered) article length, sealed package length, and distance from film outline to leading edge of registration mark. After the parameter relating to the distance from the film cut line to the leading edge of the registration mark is entered, the continue to create menu is again displayed. Depressing keypad key F2 in the continue create menu accesses the display record menu which prompts the operator to enter machine data which comprises distance between web sensor and dog drop off, idler arm angle hole number, idler arm extension scale reading, and part number of the former. After all this data has been entered, the CRT again displays the continue create menu which includes function "enter running data" achieved by depressing F3 on the keypad which will prompt the operator to input running data consisting of film cut-off length. The continue create menu is again displayed and the function create and exit accessed by depressing key F5 on the keypad prompts the computer to calculate all of the remaining data needed to run the job. The record manager menu is promptly thereafter displayed on the CRT. Accessing the function exit record manager by depressing F6 on the keypad displays the servo flow main menu on the CRT. Accessing function set-up on the main menu takes place when F2 on the keypad is depressed bringing up or displaying the set-up menu. Concurrently, also displayed are the values for several mechanical adjustments required to be performed by the operator. The function continue of the set-up menu is accessed by depressing key F5 on the keypad which displays on the CRT a following set of mechanical adjustments that are to be made. For example, these adjustments may comprise pitch diameter of the second head, number of crimpers per shaft on the second head, fact width of second head, and bearing box orientation of the second head. These adjustments only apply to a wrapping machine which is provided with tandem crimpers, which are shown in FIG. 2. The exit set-up function of the set-up menu is accessed by depressing F6 on the keypad bringing up the main menu on the CRT.

The next menu will be displayed, and displayed only in the event registered film being used, is the register function of the servo flow main menu being displayed by depressing F3 on the keypad. With the register menu displayed depressing F1 on the keypad brings up and displays menu register cancel and concurrently therewith the operator is prompted to start the main drive. If all is deemed to be in order the start button is depressed to start the machine in operation. After a trial run consisting of several repeat lengths of film through the machine, the register menu is again displayed. Access to the function crimper of the register menu occurs on pressing F2 on the keypad indicates that the trial run of several repeat lengths is in order so that the job may proceed and thereafter the main menu is again displayed by pressing key F6 on the keypad which will display the main servo flow menu on the CRT. At this time all inputs are deemed to be in order and the operator may press key F4 on the keypad accessing the go menu. Concurrently, the CRT will prompt the operation by displaying "if ready start the main drive". At this point, the operator merely has to depress the start button and run the machine at a desired speed.

Figure 8:
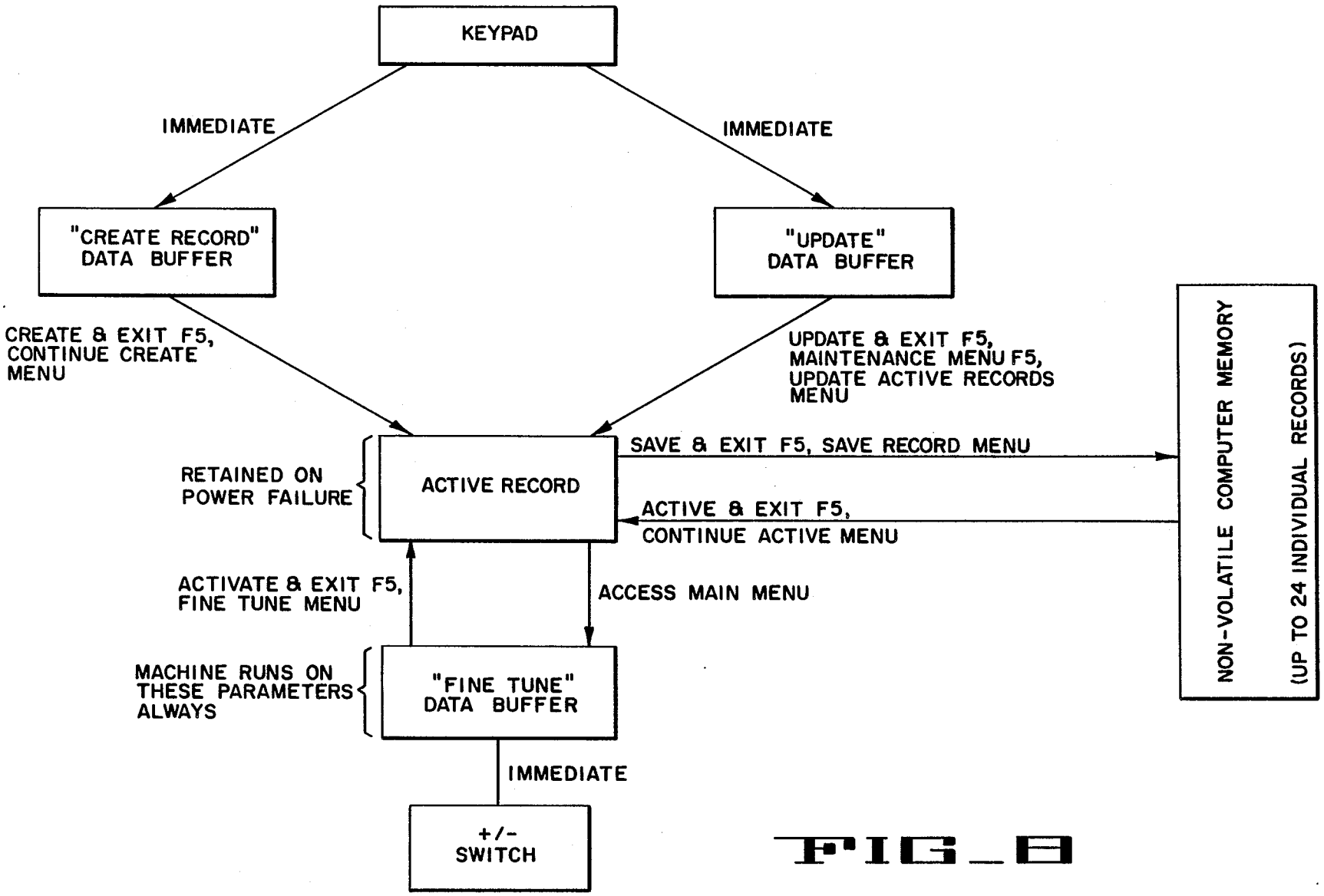
FIG. 8 is a data flow map.

FIG. 8 functionally illustrates the above-described data flow network. It will be seen that parameters entered into the keypad are promptly stored in the create record data buffer and any variations or additions to the data is stored in the update data buffer. Data from the buffers is put into the active record by accessing, through key F5, of the create and exit menu. Updating data is put into the active record by pressing key F5 on the update and record menu, depressing F5 of the maintenance menu and depressing key F5 on the update active record menu. The set of parameters for a specific job is thus input to the active record and if it is desired to save the record key F5 on the keypad is pressed introducing the data in the computer memory with an associated job number for future use. As noted in FIG. 8, the computer memory has sufficient capacity to retain 24 individual records.

A job stored in memory in the computer may be put into the active record by depressing key F5 of the keypad relating to the continue activate menu. During operation if the operator desires to make adjustments to the parameters the fine-tuned menu is accessed by depressing key F4 on the keypad and thus display on the CRT the fine-tuned menu. The fine-tuned menu includes a variety of functions which can be modified during machine operation. The data flow line associated with the legend "access main menu" is intended to indicate that the main menu is accessible to the fine-tuned data buffer and the outputs therefrom consist of the parameters communicated to the machine to run a specific job. During running of a specific job, accessing the fine-tuned menu may adjust those parameters, specifically web position and cut-off lengths, as deemed appropriate by the operator by pressing key F5, activate and exit, of the fine-tuned menu. Fine tune adjustments, as indicated by the data flow line are introduced into the acitve record. The "fine-tune" data buffer stores all of the parameters controlling machine operation.

The switch associated with the legend +/− represents a lever of the operator's control panel which can be actuated in the plus direction or the negative direction to effect fine-tuning by the operator in the event visual assessment indicates for example, speeding up or retardation of the web velocity. These adjustments are stored in the fine-tune data buffer.

A horizontal machine incorporating the concept of the present invention provides a variety of advantages relating to its operation, maintenance, and customer management. The operator's task is made much easier since computer calculated initial set-ups and computer prompted by number settings for mechanical adjustment prompts all inputs required by the operator. The computer program also provides for enunciation which serves to direct the operator's attention to the specific problem at hand. Computer control has high reliability and a reduced mechanical maintenance requirement because many of the more complex drive mechanisms have been eliminated and at the same time fault indication and self-diagnostics are built into the machine controls to minimize the trouble-shooting task of maintenance personnel.

With respect to computer controlled wrapping machines of the prior art it is very significant that the disclosed computer controller wrapping machine can automatically respond to changes in supply rate of the process because the wrapping rate can be controlled by an analog signal to the DC drive control of the wrapper main drive motor 52. Further, as compared to prior art computer controller wrapping machines, the disclosed wrapping machine of the present invention is well suited for tie-in with accessory equipment on a 1:1 relationship and is well-suited to be subservient to a process for purposes of controlling article backlog in response to supply rate changes. Moreover, the computer control drive arrangements of the disclosed wrapper are digitally controlled on a machine-timed basis enabling error sensing and proportional corrections in machine-timing so that corrections may occur during acceleration and deceleration as well as during constant velocity operations of the machine. Further, with regard to the control system in the present invention, the disclosed system distinguishes from current commercially available systems because the main drive pulse generator is a 1:1 shaft. This produces perfectly spaced machine-time reference pulses and is preferable to obtaining timing reference pulses by the sensing of flights, dogs or articles which are not perfectly spaced or oriented. The handwheel 84 secured to the shaft 60 allows the wrapper to function in the event the operator wishes to make sole packages while the main motor 52 is deenergized. This is possible since the disclosed computer controlled servo drive mechanism enables the servo slave motors to follow the deenergized main drive motor 52 when the motor is handwheel operated in either direction.

Although the best mode contemplated for carrying out the present invention has been herein shown and described, it will be apparent that modifications and variations may be made without departing what is regarded to be the subject matter of the present invention.

What is claimed is:

1. A method of operating a horizontal wrapping machine comprising a supply drive motor for supplying a succession of regularly spaced articles into a tubular web, means for feeding and sealing the margins of the formed web, and means for transversely sealing and cutting the web tube to produce packages having at least one article contained therein, the method comprising the steps of:

generating a signal representative of the velocity and position of the article supply drive motor;

digitizing the velocity and position signal; and using the digitized representative velocity and position signal to control the velocity of the feeding and sealing and cutting motors.

2. A horizontal wrapping machine comprising:

a wrapper;

a crimper;

a master motor having a master encoder coupled thereto;

a web feed and fin seal servo motor having a slave encoder coupled thereto;

a sealing head servo motor having a slave encoder coupled thereto;

an industrial computer receiving input signals from said master encoder and sending output signals to said web feed and fin seal servo motor and to said sealing head servo motor; said output signal to said web feed and fin seal servo motor being proportional to the input of the master encoder at a preset ratio to thereby feed a selected amount of web to said wrapper; and said output signal from said computer to said crimper and sealing head servo motor being a direct ratio to said master encoder input to said computer.

* * * * *